United States Patent [19]

Bloch et al.

[11] Patent Number: 4,825,184

[45] Date of Patent: Apr. 25, 1989

[54] CURRENT CONTROLLED INDUCTOR

[75] Inventors: Joseph T. Bloch, Seattle; Todd N. Johnstone, Federal Way, both of Wash.

[73] Assignee: The Boeing Company, Seattle, Wash.

[21] Appl. No.: 69,814

[22] Filed: Jul. 6, 1987

[51] Int. Cl.[4] ..... H01F 21/04

[52] U.S. Cl. ..... 336/20; 336/30; 337/140

[58] Field of Search ..... 337/140; 60/527; 336/30, 20, 179

[56] References Cited

U.S. PATENT DOCUMENTS

| | | | |
|---|---|---|---|
| 1,961,783 | 6/1934 | Roder | 336/20 |
| 2,563,413 | 8/1951 | Ostrow | 336/20 |
| 2,954,538 | 9/1960 | Horgan | 336/30 |
| 3,152,312 | 10/1964 | Johnson | 336/179 |
| 3,239,783 | 3/1966 | Yetter | 336/179 |
| 3,634,803 | 1/1972 | Willson et al. | 337/140 X |
| 3,648,205 | 3/1972 | Bunch et al. | 336/20 |
| 3,652,969 | 3/1972 | Willson et al. | 337/140 |
| 3,731,247 | 5/1973 | Leuinn | 337/140 |
| 4,281,513 | 8/1981 | Johnson et al. | 60/527 |
| 4,325,040 | 4/1982 | Whitley | 336/20 X |
| 4,490,975 | 1/1985 | Yaeger et al. | 337/140 |
| 4,517,543 | 5/1985 | Brubaker | 337/140 |
| 4,524,343 | 6/1985 | Morgan | 337/140 |

OTHER PUBLICATIONS

"Control Design with Vease Via Electrically Actuated Shape-Memory Effect," Raychem Corp.

Stoddard, Walter D. et al., "Robotic Applications for Shape Memory Alloy."

*Primary Examiner*—Thomas J. Kozma

*Attorney, Agent, or Firm*—Christensen, O'Connor, Johnson & Kindness

[57] ABSTRACT

A current controlled inductor (1) having an inductor coil (4) in one state of alteration attached at one end to a displacing coil (6) in an opposite state of alteration to that of the inductor coil (4). Both coils are formed of a shape memory alloy that when heated to a predetermined temperature will return to an original configuration from an altered configuration. An electric current from a DC source (11) passing through the displacing coil (6), heats the displacing coil (6), causing the coil to contract to an original length and simultaneously pull the inductor coil (4) from its original length thereby changing the inductance effect of the inductor coil (4) on the signal source (12).

13 Claims, 2 Drawing Sheets

CURRENT CONTROLLED INDUCTOR

TECHNICAL FIELD

This invention relates to an inductor for electric circuits, and, more particularly, to a current controlled variable inductor.

BACKGROUND OF THE INVENTION

Typically, the inductance of a single layer air coil is varied by either moving a slug in and out of the coil or changing the length of the coil, such as by moving a sliding contact along the coil. In either case, mechanical devices are used to bring about a change in the inductance of the coil. The size, weight and lack of reliability of these devices render them unsuitable for applications in certain environments, such as in space vehicles. More specifically, a major drawback to the use of mechanically actuated variable inductors in a space vehicle is the extra weight they add to the electronic hardware. In addition, the motors, switches, relays, etc. required to operate the mechanical devices add weight and take up valuable space. Furthermore, mechanically varied inductors are subject to malfunctioning, especially in space applications where severe vibrational loads are encountered. These and other disadvantages are overcome by the present invention.

SUMMARY OF THE INVENTION

In accordance with this invention, a current controlled inductor suitable for providing a variable inductance in an electric circuit is provided. The inductor comprises a coil of electrically conductive wire formed of a shape memory alloy. Variable inductance is created by altering the length of the coil by stretching the coil. The length of the coil is returned to its original length from its altered length by heating the coil to a predetermined temperature. Preferably, the heating is accomplished by passing an electric current through the coil. Various devices can be used to alter the original length of the coil.

In accordance with other aspects of the invention, a coil spring connected to one end of the shape memory alloy coil is used to alter the original length of the shape memory coil. Preferably, the coil spring that alters the original length of the coil is also formed of a shape memory alloy.

In accordance with further aspects of the present invention, the second coil of shape memory alloy is in an opposite state of alteration than the first coil, i.e., the second coil is unaltered when the first coil is altered, and vice versa. As a result, the return of the second coil to its original length results in an alteration of the original length of the first coil. This allows the alteration state of the first and second coils to be used to permit selective variation in either of their lengths to any new desired length between their original length and a maximum altered length.

As will be readily appreciated from the foregoing description, a current controlled inductor formed in accordance with the present invention does away with the need for mechanical devices for varying the inductance of a coil. Rather than using a mechanical device, inductance is varied by changing the coil length, which changes the inductive coupling between coil loops. Coil length, and thus coil inductance, is changeable by the simple expedient of applying an electric current of adequate magnitude to a coil formed of a shape memory alloy. As a result, the invention eliminates the need for heavy and bulky mechanical actuation devices and results in a lighter, more compact, and reliable variable inductor.

BRIEF DESCRIPTION OF THE DRAWINGS

The foregoing and other advantages and features of this invention will become more readily appreciated as the same becomes better understood by reference to the following detailed description when taken in conjunction with the accompanying drawings wherein.

DETAILED DESCRIPTION OF THE PREFERRED EMBODIMENT

Figure 1:
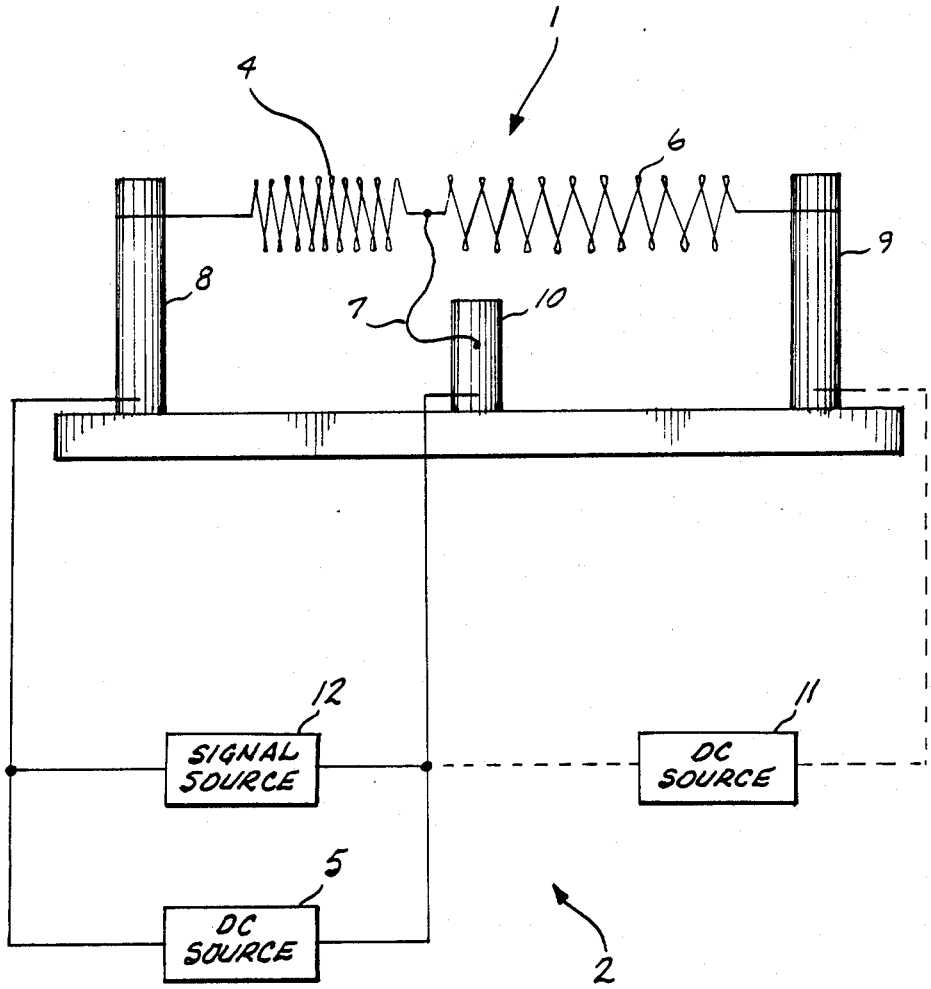
FIG. 1 is a side view of a current controlled inductor formed in accordance with the the present invention in combination with an electronic circuit for producing controlling current.

FIG. 1 is a side view of a current controlled inductor 1 and an associated electronic circuit 2 that illustrate the general principles of the present invention. The inductor 1 comprises an inductor coil 4 and a displacing coil 6. Both coils are single layer coils. The inductor coil 4 is formed of a shape memory alloy that is available commercially in wire form. A shape memory alloy is an alloy that returns to a "remembered" shape when heated. The displacing coil 6 may be formed of steel or some other resilient material, e.g., brass or plastic, commonly used to create springs. The force produced by the displacing coil 6 must be adequate to stretch the inductor coil 4 when the coil is not being heated and inadequate to maintain the inductor coil 4 stretched when it is heated. Alternatively, the displacing coil 6 can also be formed of a shape memory alloy.

The inductor coil 4 and the displacing coil 6 are attached together at one end. The other or free end of the inductor coil 4 is attached to a first stationary terminal post 8, and likewise the free end of the displacing coil 6 is attached to a second stationary terminal post 9. The junction of the inductor coil 4 and the displacing coil 6 is connected by a flexible connector 7 to a center post 10 located between the first and second posts 8 and 9. To avoid interference with the inductor coil 4 by the displacing coil 6, a signal blocking device could be installed at the junction of the two coils or at other locations as required by the particular signal circuit.

As noted above, a shape memory alloy, of which the inductor coil 4, and in this case the displacing coil 6, are constructed, has the characteristic that, after it is deformed, it will return to its original shape upon heating above its phase transition point. It is known that electric current of sufficient amperage can heat the alloy to the transition temperature. Thus, as shown in FIG. 1, when sufficient DC current from a first DC source 5 is passed through the inductor coil 4 or when sufficient DC current from a second DC source 11 is passed through the displacing coil 6, the passing current will generate enough heat to heat the related coil to its phase transition temperature. As a result, the heated coil will contract to a remembered length. As the heated coil contracts, it stretches the unheated coil. Thus, as current from the second DC source 11 heats the displacing coil 6 and causes it to contract, the inductor coil 4 is stretched to a greater length. Conversely, when current from the first DC source 5 is passed through the inductor coil 4, it will contract to its remembered length and simultaneously stretch the displacing coil 6 from its remembered length.

It is well known that an inductor coil placed in an alternating current circuit will have an inductance L. It is also known that for a given inductor coil, L will vary inversely as the coil length of the inductor is changed. Thus, when the inductor coil 4 is changed in the manner described above, its inductance will change. Consequently, when such a coil is connected in an electronic circuit, illustrated as a signal source 12 in FIG. 1, the circuit inductance created by the coil will change as the length of the coil changes.

Figures 2, 3, 4:
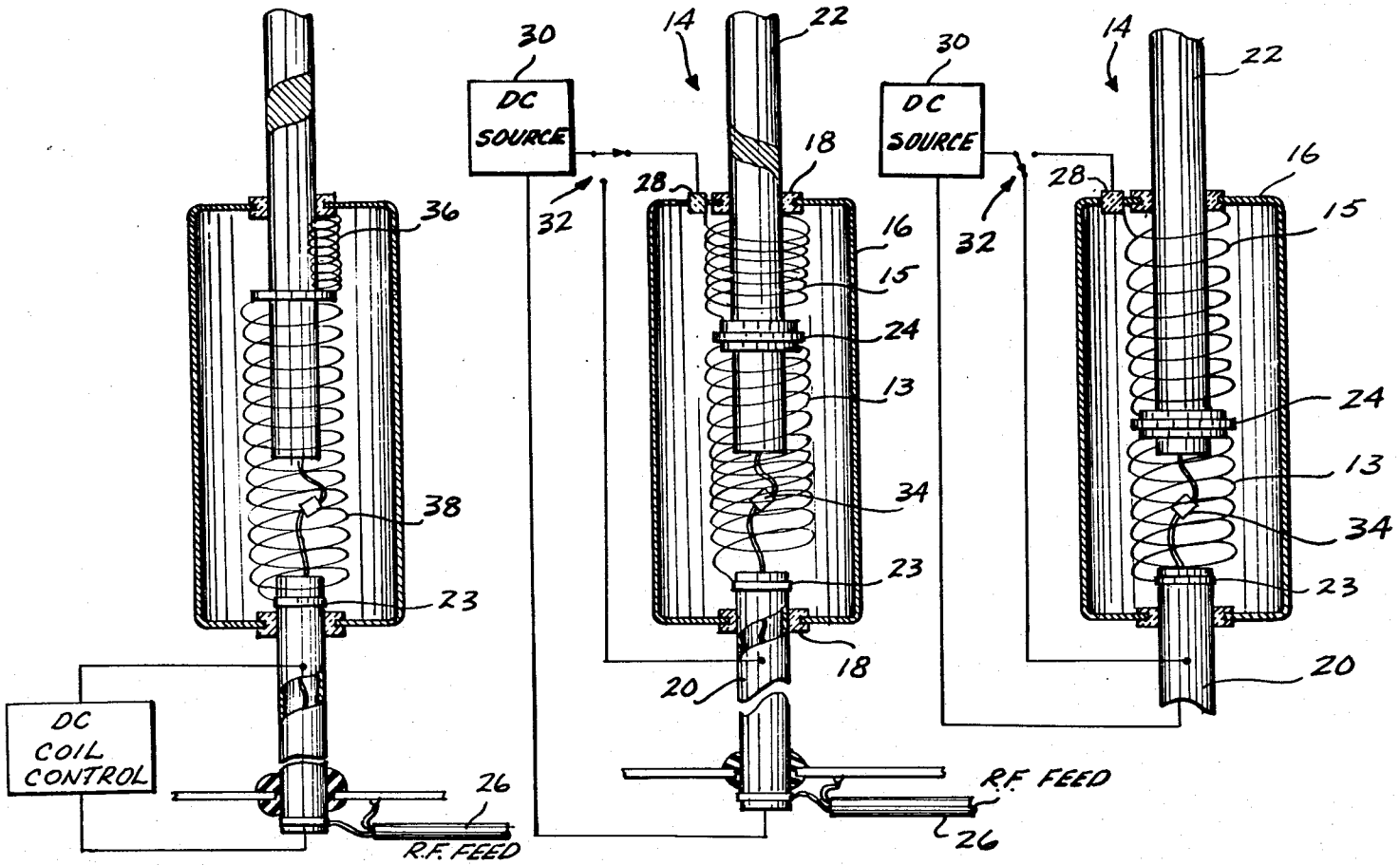
FIG. 2 is a sectional view of one embodiment of an inductor formed in accordance with the present invention in one state of alteration.
FIG. 3 is a sectional view of the inductor of FIG. 2 in a state of alteration opposite to that shown in FIG. 3.
FIG. 4 is a sectional view showing an alternative embodiment of the invention in a first state of alteration.

FIG. 2 is a sectional view of one embodiment of an inductor coil 13 formed in accordance with the present invention installed as a loading coil for a center loaded antenna 14. In this application, the inductor coil 13 and the displacing coil 15 are enclosed within a cylindrically shaped, wheatherproof canister 16. Located at either end of the canister 16 are reinforcing rings 18. A hollow tube 20 enters the bottom through the lower reinforcing ring 18 and a solid rod 22 exits the top through the upper reinforcing ring 18. One end of the inductor coil 13 is electrically connected to the top of the tube 20 at a fixed location 23. The other end of the inductor coil is electrically connected to the rod 22 by means of a sliding contact 24. One end of the displacing coil 15 is also electrically connected to the rod 22 by means of the sliding contact 24. The other end of the displacing coil is electrically connected to a terminal 28 on the canister 16. The terminal 28 is insulated from the canister 16 and the rod 22 to avoid electrical interference between the displacing coil current and the radio frequency signal. The sliding contact 24 allows the inductor coil 13 and the displacing coil 15 to make continuous electrical contact with the rod 22. When a radio frequency feed 26 is attached to the tube 20 and excited, the radio frequency signal travels from the tube 20 through the inductor coil 13 and along the rod 22. Thus, the radio frequency signal "sees" the inductor coil 13 as a standard loading coil that, in effect, increases the length of the antenna 14.

A DC source 30 is also shown in FIG. 2 having one lead that passes through the tube and is connected to the rod 22 through a radio frequency choke 34. The other lead from the DC source 30 is connected to the common terminal of a single pole-double throw switch 32 that selectively connects the DC source to either the inductor coil 13 or the displacing coil 15 via the tube 20 or the terminal 28, respectively. FIG. 2 shows the switch 32 connected to the displacing coil 15 through the terminal 28. When the switch 32 is in this position, electric current flows from the DC source 30 to the displacing coil 15, through the sliding contact 24 and the rod 22 to the choke 34, and then back to the DC source 30. As the electric current flows, the resistance of the displacing coil 15 generates heat that causes the displacing coil 15 to contract to its remembered length when the temperature reaches the phase transition temperature of the shape memory alloy used for the displacing coil. The contraction of the displacing coil 15 pulls the sliding contact 24 and the attached end of the inductor coil 13 up the rod 22, thereby stretching the length of the inductor coil 13. The change in the length of the inductor coil 13 causes a change in its inductance by changing the inductive coupling between the coil loops. This results in a change in the performance characteristics of the antenna 14. It is to be understood that signal blocking devices similar to the choke 34 may be installed at other locations in the antenna circuit to avoid interference between the DC source and the coils.

FIG. 3 shows the inductor coil 13 in an opposite state of alteration from that of FIG. 2. In this configuration, the DC source 30 is connected to the inductor coil 13 through the switch 32. Current flows through the inductor coil 13, the slipper contact 24, and back to the DC source 30 through the rod 22 and the choke 34. The DC current flowing through the inductor coil 13 causes it to contract to its remembered length, pulling the slipper contact 24 down the rod 22 and stretching the length of the displacing coil 15. The choke 34 blocks the radio frequency current to prevent it from passing through the coil control circuit. Likewise, similar signal blocking devices can be installed on the DC source 30 lead lines, depending on the construction of the antenna 14.

FIG. 4 is a sectional view showing an alternative embodiment of the invention, wherein a mechanical spring 36 is used to provide tension to the inductor coil 38. In this configuration, the inductor coil 38 will maintain its remembered length only as long as DC current is applied to it. Upon release of the current, the inductor coil 38 is pulled back to an altered length by the spring 36. This particular embodiment only allows the inductor coil 38 to be varied between two lengths. This is in contrast to the first embodiment shown in FIGS. 2 and 3, wherein the inductor coil 13 may be adjusted to a limitless number of lengths.

As will be apparent from the foregoing description, this invention replaces center loading inductors used for a fixed frequency, or multi-band inductors that are adjusted mechanically. The present invention allows operation of the antenna over a broad frequency range through current control of the loading coil inductance. While preferred embodiments of the invention have been shown and described, it will be appreciated that various changes can be made therein without departing from the spirit and scope of the invention. For instance, a weight or air pressure sensitive device may be attached to one end of the inductor to cause it to deform from its remembered length. Consequently, the invention can be practiced otherwise than as specifically described herein.

The embodiments of the invention in which an exclusive property or privilege is claimed are defined as follows:

1. A current controlled inductor that provides a variable inductance in an electric circuit, comprising:

(a) a coil of electrically conductive wire formed of a shape memory allow that returns said coil to an original length from an altered length when heated to a predetermined temperature by an electric current flowing through said coil such that, as the length of the coil is altered, a change in the inductance of the coil alters the electric circuit;

(b) means for altering the original length of said coil; and, (c) means electrically connecting the coil to the electric circuit.

2. The inductor in the circuit of claim 1, wherein said means for altering the original length of said coil comprises a spring.

3. The inductor in the circuit of claim 1, wherein said means for altering the original length of said coil that returns to an original length from an altered length comprises a second coil of electrically conductive wire formed of a shape memory alloy.

4. The inductor in the circuit of claim 3, wherein said second coil is in an opposite state of alteration that said first coil such that upon return of said second coil to its original length said first coil is altered from its original length.

5. The inductor in the circuit of claim 4, wherein said first coil and said second coil cooperate to permit selective variation in either of their lengths to any new desired length between their original length and a maximum altered length.

6. A current controlled inductor that provides a variable inductance in an electric circuit, comprising:

(a) a coil of electrically conductive wire formed of a shape memory alloy, said coil having an original length to which said coil returns to change the inductance thereof when it is heated to a predetermined temperature;

(b) means for altering the original length of said coil to change the inductance of said coil, said change in the inductance of the coil alters the electric circuit;

(c) an electric power source connected to said coil to create a flow of current through said coil that heats said wire to said predetermined temperature to cause said coil to return to its original length after the original length of said coil is altered by said means for altering the original length of said coil;

(d) means electrically connecting the coil to the electric circuit as the length of the coil is altered; and, (e) means for preventing electrical interference in the electric circuit by the flow of current through the coil from the electric power source.

7. The inductor in the circuit of claim 6, wherein said means for altering the original length of said coil comprises a spring.

8. The inductor in the circuit of claim 6, wherein said means for altering the original length of said coil comprises a second coil of electrically conductive wire formed of a shape memory alloy.

9. The inductor in the circuit of claim 8, wherein said second coil is in an opposite state of alteration than said first coil such that upon return of said second coil to its original length said first coil is altered from its original length.

10. The inductor in the circuit of claim 9, wherein said first coil and said second coil cooperate to permit selective variation in either of their lengths to any new desired length between their original length and a maximum altered length.

11. A current-controlled inductor that provides a variable inductance in an electric circuit that includes an antenna rod, comprising:

a first coil of electrically conductive wire formed of a shape memory alloy that returns said first coil to an original length from an altered length when heated to a predetermined temperature by an electric current flowing through said first coil;

a second coil of electrically conductive wire connected to said first coil, said second coil being formed of a shape memory alloy that returns said second coil to an original length from an altered length when heated to a predetermined temperature by an electric current flowing through said second coil, said second coil being in an opposite state of alteration from said first coil to alter the original length of said first coil to an altered length such that, as the length of said first coil is altered, a change in the inductance of said first coil alters the electric circuit;

a contact electrically connected to said first coil and slidably mounted on the antenna rod for providing electrical contact between said first coil and the antenna rod as the length of said first coil is altered;

an electric power source selectively connectable to said first coil and said second coil to create a flow of current that heats said first coil or said second coil to said predetermined temperature; and, means for preventing electrical interference in the electric circuit by the flow of current through said first coil and said second coil.

12. The inductor in the circuit claimed in claim 11, further comprising a switch means for selectively connecting said electric power source to said first coil and said second coil.

13. The inductor in the circuit of claim 12, wherein said first coil and said second coil cooperate to permit selective variation in either of their lengths to any new desired length between their original length and a maximum altered length.

* * * * *